US005895897A

United States Patent [19]

Oishi et al.

[11] Patent Number: 5,895,897

[45] Date of Patent: Apr. 20, 1999

[54] LIGHT-WEIGHT CERAMIC ACOUSTIC ABSORBER AND METHOD OF MANUFACTURING THE SAME

[75] Inventors: Tsutomu Oishi, Saitama; Yoshiya Nakamura, Tokyo; Hiroya Ishizuka; Takeo Sasaki, both of Saitama, all of Japan

[73] Assignee: Ishikawajima-Harima Heavy Industries Co., Ltd., Tokyo, Japan

[21] Appl. No.: 08/996,514

[22] Filed: Dec. 23, 1997

[30] Foreign Application Priority Data

Dec. 26, 1996 [JP] Japan ..... 8-347418
Dec. 27, 1996 [JP] Japan ..... 8-349894

[51] Int. Cl.[6] ..... E04B 1/82

[52] U.S. Cl. ..... 181/286; 181/294; 428/312.2; 264/42; 501/84

[58] Field of Search ..... 181/284, 286, 181/288, 290, 292, 293, 294; 264/42, 43; 501/80, 84, 85; 156/89.24; 428/312.2, 312.8

[56] References Cited

U.S. PATENT DOCUMENTS 3,949,029 4/1976 Ulisch ..... 264/42
4,756,956 7/1988 Nagai et al. ..... 428/312.2
5,684,278 11/1997 Yasukawa et al. ..... 181/286
5,773,121 6/1998 Meteer et al. ..... 181/292

FOREIGN PATENT DOCUMENTS 61-143501 1/1986 Japan .
61-44102 3/1986 Japan .
3-223184 2/1991 Japan .
6-42071 2/1994 Japan .
6-247778 6/1994 Japan .

*Primary Examiner*—Khanh Dang
*Attorney, Agent, or Firm*—Griffin, Butler, Whisenhunt & Szipl, LLP

[57] ABSTRACT

There is provided a light-weight ceramic acoustic absorber including an alumina based ceramic containing SiC whiskers, as a perforated body with a void ratio in the range of 80 to 92%, where there are voids with a mean diameter in the range of 50 to 450 μm near the front surface of the body, and the void diameters are larger towards the rear surface of the body, and a mean diameter of the voids is in the range of 500 to 3,400 μm near the rear surface of the body, and there is an increasing trend in void diameters from the front to the rear surfaces. The light-weight ceramic acoustic absorber provides various advantages such as light weight, high resistance to thermal stresses, high acoustic absorptivity, and high resistance to the gas jet from a jet engine.

7 Claims, 8 Drawing Sheets

LIGHT-WEIGHT CERAMIC ACOUSTIC ABSORBER AND METHOD OF MANUFACTURING THE SAME

BACKGROUND OF THE INVENTION

1. Technical Field of the Invention

The present invention relates to a light-weight ceramic acoustic absorber used for the exhaust nozzles etc. of a jet engine, which is light in weight and has excellent resistance to thermal stresses and excellent sound absorbing properties, and also to a method of manufacturing the same.

2. Description of the Prior Art

An acoustic absorber, with the honeycomb structure shown in FIG. 1 as an example, has been used conventionally as an acoustic absorber for the exhaust nozzles etc. of a jet engine. This honeycomb acoustic absorber consists of a honeycomb 1 of a heat-resistant alloy, a perforated plate 2 and a back plate 3, and this is a reactive type of Helmholtz resonator; the absorber dissipates energy through losses caused by the friction of a medium with a wall surface and the relative motion of the medium to the surface.

However, this type of honeycomb acoustic absorber suffered from problems such as overheating of the perforated plate 2 or the internal honeycomb 1 or the back plate 3 by exhaust gas at a high temperature (for example, in the range of 700 to 800 K or greater), or excessive thermal distortion. More specifically, the perforated plate 2 often consists of, for example, a stainless steel or aluminum plate, therefore the plate may be damaged or thermally deformed when overheated, and furthermore, the portion where it is welded to the honeycomb 1 might become detached. More seriously, with this sound absorption structure, the bandwidth of the absorbable noise is so narrow that noise with a large bandwidth from a jet engine etc. (for example, in the range of 1000 to 3,000 Hz) cannot be absorbed completely.

On the other hand, a resistance type acoustic absorber consisting of a perforated layer and a fiber layer, is also known in the prior art, and various related embodiments have been proposed (for example, Japanese Unexamined Patent Publications Nos. 61-143501, 61-44102, 6-42071 and 6-247778).

However, the above-mentioned Japanese Unexamined Patent Publication No. 61-143501 by the title of "Manufacturing method of perforated acoustic absorber" and the Japanese Unexamined Patent publication No. 61-44102 by the title of "Light-weight, high-strength acoustic absorber" relate to a material composed of metal particles, together with a residual void ratio as low as 20–50%, therefore they have problems which include a low heat resistance and large specific and total weights.

The Japanese Unexamined Patent Publication No. 6-42071 by the title of "Ceramic acoustic absorber" relates to a material composed of ceramic, so its resistance to thermal stresses is poor despite its high resistance to heat, because the structure as a whole, is isotropic, and the material cracks easily. Moreover, the sound absorption ratio of the material is only 60% or less in the frequency range of 1,000 to 2,000 Hz, which is a particular problem with regard to the noise from a jet engine. Consequently, this material was not satisfactory.

In accordance with the Japanese Unexamined Patent Publication No. 6-247778 by the title of "Light-weight ceramic molding with voids with controlled diameters, and a method of manufacturing the same", the growth of cracks can be delayed by virtue of the graduated location of the voids, but the sound absorption performance is not satisfactory. Also when the invention is applied to a jet engine, the molding can easily be broken off if the surface of the molding is overheated by a gas jet.

SUMMARY OF THE INVENTION

The present invention has been originated to solve the various problems described above. In other words, the objective of the present invention is to provide a light-weight ceramic acoustic absorber which is light and has excellent resistance to thermal stresses, and has a large capability of absorbing noise and can withstand the gas jet from a jet engine, and the method of manufacturing it.

The inventors of the present invention directed their attention to the fact that when the resistance to flow is increased, the acoustic absorptivity increases, and they succeeded in improving the acoustic absorptivity by adding silicon carbide fibers without changing the bulk density, thereby controlling the flow resistance substantially without changing the weight. The present invention is based on this novel knowledge.

In detail, the present invention offers a light-weight ceramic acoustic absorber consisting of an alumina based ceramic including SiC whiskers. The absorber is a perforated body with a void ratio ranging from 80 to 92%. The voids have a mean diameter in the range of 50 to 450 μm near the surface, and the diameter of the voids increases as they get closer to the rear surface. Near the rear surface, the average void diameter is in the range of 500 to 3,400 μm, that is, the diameter of the voids is gradually increased from the front surface to the rear surface.

In accordance with the composition used in the present invention, the alumina based ceramic is light because the ratio of the voids is in the range of 80 to 92% by volume, and the ceramic is reinforced by SiC whiskers (silicon carbide fibers), so the resistance of the ceramic to thermal stresses is also excellent and the ceramic can withstand a gas jet for a long time even if the ceramic is exposed directly. In addition, there are voids with a mean diameter in the range of 50 to 450 μm near the front surface, and for voids closer to the rear surface, the void diameter is increased up to a maximum mean diameter in the range of 500 to 3,400 μm near the rear surface, that is, the void diameter increases from the front to the rear surfaces. Therefore, even if a crack is produced locally, the rate of crack growth becomes smaller as the crack tip proceeds towards the front surface, and also because the ceramic is reinforced with SiC whiskers (silicon carbide fibers), its resistance to thermal stresses can be increased further, so it becomes more difficult for cracks to propagate to the front surface than for the methods known in the prior art.

The present invention offers a foamed ceramic consisting of a perforated body with a void ratio in the range of 80 to 92% and a dense layer provided on the surface of the foamed ceramic, including ceramic fibers, and the dense layer is provided with voids over a mean thickness of about 1,000 μm or less and with a mean diameter in the range of 10 to 50 μm. In this way the invention provides a light-weight, ceramic acoustic absorber.

In accordance with the above-mentioned configuration of the present invention, the foamed ceramic itself is light and highly resistant to thermal stresses, and by virtue of a dense layer produced on the surface of the ceramic, the ceramic can confine noise effectively, which has been confirmed through an experiment. Because the dense layer is reinforced by ceramic fibers, the resistance to thermal stresses can be increased further, so even if the ceramic is exposed directly to a gas jet, the ceramic can withstand the exposure for a long time.

According to a preferred embodiment of the present invention, the dense layer provides a flow resistance in the range of about 4 to about 60 cgs Rayls/cm. For a flow resistance in this range, it has been confirmed that compared to a layer with a flow resistance of about 1 cgs Rayls/cm, the noise absorption, particularly near 1 kHz, is increased by 20 to 50%.

The aforementioned foamed ceramic contains voids with a mean diameter in the range of 50 to 450 μm near the front surface in contact with the dense layer, and closer to the rear surface, the air voids become larger, and in the vicinity of the rear surface, the mean void diameter becomes 500 to 3,400 μm, that is, the void diameters tend to increase from the front to the rear surfaces. With this configuration, even if a crack is produced locally, the growth rate of the crack becomes smaller as the crack gets closer to the front surface. Furthermore, because the dense layer near the front surface is reinforced by ceramic fibers, the resistance to thermal stresses can be increased further, so the front surface cannot be easily cracked, and the ceramic can resist a gas jet for a long time, even if directly exposed.

In accordance with the present invention, a foamed slurry is produced by mixing an alumina based ceramic powder, SiC whiskers, and a solution containing a dispersant, an organic binder and a foaming agent in water. The slurry is poured into a mold, and the bubble diameter is controlled by the rate at which the bubbles coalesce while the molded part is being dewatered and dried. The molded part is removed from dies, then degreased and baked, thereby manufacturing a light-weight ceramic acoustic absorber.

In accordance with this method, SiC whiskers (silicon carbide fibers) can be incorporated into the alumina based ceramic, and by adjusting the material of the molding dies and the rate at which the dies absorb water, dewatering and drying conditions can be controlled optimally, thus the growth rate of the voids can be controlled. In this way, a dense layer can be formed while voids which tend to have various diameters are also created.

According to another aspect of the present invention, a foamed slurry is produced by mixing a ceramic powder with an aqueous solution containing a dispersant, an organic binder and a foaming agent, and ceramic fibers are placed in the molding dies at the location where a dense layer is to be formed. The slurry is poured into the molding dies, and the increase in bubble diameters is controlled by the rate at which the bubbles coalesce while the slurry is dewatered and dried. The molding is removed from the dies, degreased and baked. In this way, the present invention provides a method of manufacturing a light-weight ceramic acoustic absorber.

In accordance with this method, a dense layer including ceramic fibers can be integrated with a foamed ceramic. By controlling the dewatering and drying of the integrated body by changing the material of the dies and their rate of water absorption, the growth of bubbles can be controlled, thereby the dense layer can be formed and diameter-controlled voids can also be created.

In accordance with a preferred embodiment of the present invention, the dense layer is produced by using an increased drying rate at the surface during the above-mentioned dewatering and drying. More explicitly, molding dies consisting of gypsum etc. which are highly hygroscopic are used, or the surface is exposed to atmospheric air, so that the drying rate of the surface is increased and a dense layer with a low void ratio is therefore formed on the surface.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
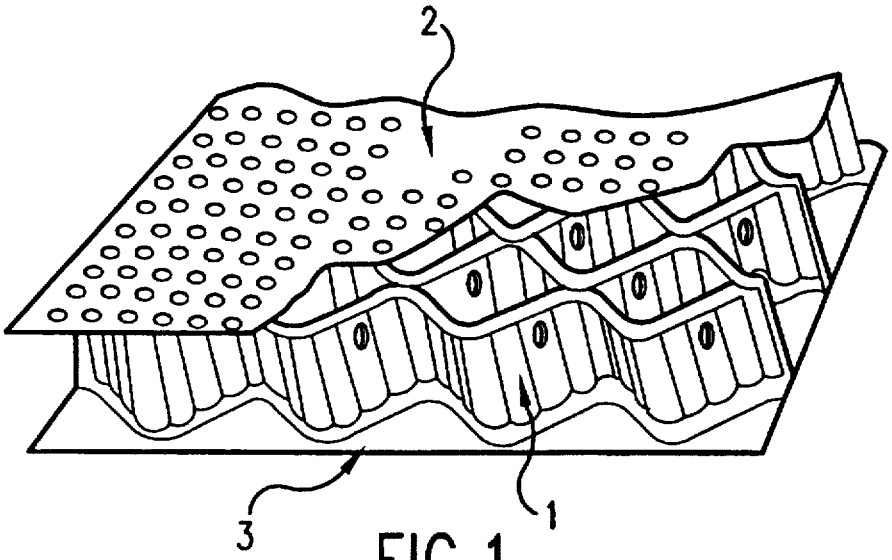
FIG. 1 PRIOR ART
FIG. 1 is a view of a conventional acoustic absorber for high temperature applications.
Figure 2:
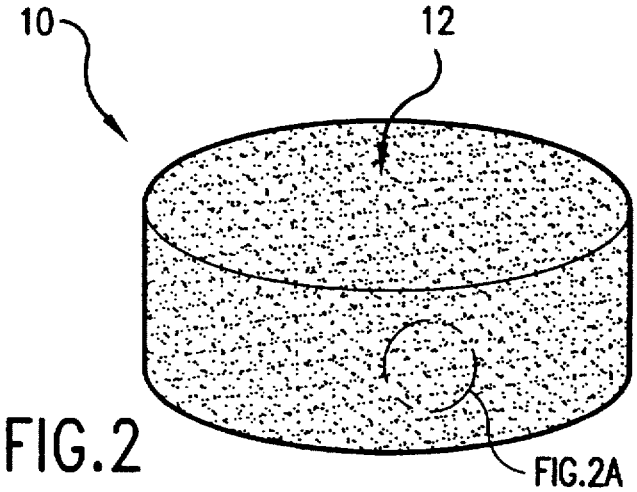
FIGS. 2 and 2A are general views of the acoustic absorber in accordance with the present invention.
Figure 2A:
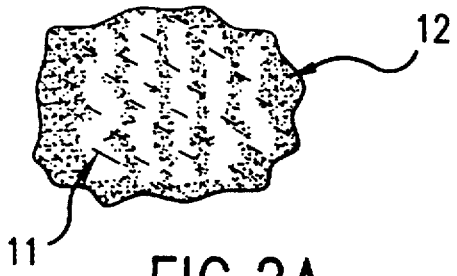

FIG. 2 and 2A are structural views of an element of a light-weight, ceramic acoustic absorber in accordance with the present invention. As shown in this view, the light-weight, ceramic acoustic absorber 10 of the present invention is a ceramic based composite material consisting of an alumina based ceramic 12 including SiC whiskers 11. The alumina based ceramic 12 is a perforated body with a void ratio in the range of 80 to 92%, and near the surface, the voids have a mean diameter in the range of 50 to 450 μm, and at locations closer to the rear surface, the void diameters become larger. Near the rear surface, the mean void diameter is in the range of 500 to 3,400 μm, that is, the void diameters tend to increase with depth from the front surface.

The SiC whiskers 11 consist of silicon carbide fibers, which are integrated into the alumina based ceramic 12, and the ceramic 12 is reinforced by the silicon carbide fibers which have a high heat resistance and tensile strength.

In accordance with the aforementioned configuration of the present invention, the alumina based ceramic 12 is light because it contains voids with a volumetric ratio ranging from 80 to 92%, and since the ceramic is reinforced by the SiC whiskers 11 (silicon carbide fibers), the resistance of the ceramic to thermal stresses is also excellent, and the ceramic can resist a gas jet for a long time even if exposed to it directly. In addition, there are voids with mean diameters in the range of 50 to 450 μm near the surface, and for locations closer to the rear surface, the voids become larger. In the proximity of the rear surface, the mean void diameter becomes 500 to 3,400 μm, i.e. the diameter of the voids increases from the front to the rear surfaces. Therefore, even if a crack is produced locally, its growth rate becomes smaller as the crack tip approaches the front layer. Furthermore, the ceramic is reinforced by SiC whiskers (silicon carbide fibers), therefore the resistance to thermal stresses can also be increased for the ceramic, so the surface layers are more resistant to cracking than those known in the prior art.

In accordance with the manufacturing method of the present invention for a light-weight ceramic acoustic absorber, an alumina based ceramic powder and SiC whiskers are mixed with a solution containing a dispersant, an organic binder and a foaming agent in water, into a foamed slurry, and the slurry is poured into molding dies. The diameter of the bubbles is determined during manufacturing by the rate at which they coalesce while the slurry is being dewatered and dried. The molded part is then removed from the dies, degreased and baked. As a result, SiC whiskers (silicon carbide fibers) can be incorporated into the alumina based ceramic. Also by controlling the dewatering and drying by using various materials for the dies and by changing the water absorption rate of the dies, the growth of bubbles can be controlled. In this way a dense layer can be produced together with the creation of voids which tend to increase in diameter from the front to the rear surfaces. As a result, an acoustic absorber with diameter-controlled voids, can be produced rather easily and relatively cheaply.

In one aspect of the present invention, SiC whiskers are integrated into the perforated body of the alumina based ceramic, thus the reinforcement is distributed throughout the body, and isolated voids can be produced. Also the void ratio and the void diameter can be controlled by using long or short silicon carbide fibers. With long fibers, the void ratio and diameter are small, and when the body contains short fibers, both the void ratio and void diameters are larger. Moreover, dewatering and drying rates can be controlled by varying the amount of water used and by using different materials for the casting mold. Taking advantage of these phenomena, the diameters of the voids can be changed to give the preferred variation from the front to the rear surfaces, thereby the resistance and strength of the ceramic to thermal stresses can be greatly improved.

Further details of the present invention will be described in the following paragraphs. The ceramic content of the light-weight ceramic acoustic absorber in accordance with the present invention is restricted to only alumina based material, and it is preferred that the material should be used as a powder or a powder-like form. This alumina based ceramic contains silicon carbide fibers. Silicon carbide fibers are classified into long-fiber, short-fiber and whisker types, but most preferably, SiC whiskers (silicon carbide fibers) should be used because their strength is ideal and they can be easily integrated into the ceramic. Also, these inorganic fibers are preferably used in forms such as fibers, rings and meshes. Fibers or meshes are the most preferred forms. The degree of reinforcing can be adjusted by controlling the amount of silicon carbide fibers added to suit the particular application, and the void ratio can be increased or decreased by using long or short fibers. The amount of silicon carbide fibers to be added is from 3% to 30% by weight of the raw ceramic material, preferably between 5% to 20% by weight. If the amount of added silicon carbide fibers is less than 3% by weight, the reinforcing effect is poor and distributed, continuous voids cannot be produced. On the other hand, if it exceeds 30% by weight, the reinforcing effect also decreases.

In one aspect of the present invention, fibers of various lengths are used in the form of a fabric, and the void ratio can be easily increased or decreased by controlling the length of the fibers. The preferred length of the fibers is in the range of 15 μm to 100 μm. A shorter fiber length results in a larger void ratio and greater void diameters, and if the length is greater than 100 μm, the void ratio and diameters are smaller than preferred values. Consequently, if the fiber length is less than 10 μm, no reinforcing effect can be expected from the fibers, and controlling the void ratio and diameters is more difficult.

With the light-weight ceramic acoustic absorber in accordance with the present invention, the void ratio is in the range of 80 to 92%, and there are voids with a mean diameter ranging from 50 to 450 μm near the front surface, and at locations closer to the rear surface, the diameters of the voids become greater, and in the proximity of the rear surface, the diameters of the voids have a mean value in the range of 500 to 3,400 μm, that is, the void diameters are distributed in accordance with a preferred trend. In the proximity of the front surface of the light-weight ceramic acoustic absorber in accordance with the present invention, there are voids with a mean diameter in the range of 50 to 450 μm, reinforced with silicon carbide fibers, resulting in a high strength absorber, and furthermore, the void ratio can be controlled by using long or short fibers of this silicon carbide. In an aspect of the present invention, voids are distributed with controlled diameters in accordance with the distance from the front and rear surfaces. However, if the void ratio is less than 80%, the absorber loses its light-weight characteristic, and if it exceeds 92%, the strength becomes undesirably low.

Although the present invention specifies voids with a diameter ranging from 10 to 500 μm near the front surface, a void diameter of less than 10 μm is not desirable because the acoustic characteristics of the absorber are unsatisfactory and also it loses its light-weight property. If the diameter exceeds 500 μm, the effect of the controlled distribution of diameters is reduced and at the same time the strength deteriorates causing cracks during casting, so a diameter of more than 500 μm is not desirable. In addition, the mean diameter of voids near the rear surface is made to be in the range of 500 to 3,400 μm in accordance with the present invention, and as a result, the acoustic absorber demonstrates a significant variation in the distribution of controlled grain diameters. Therefore, the strength obtained is acceptable in practice. However, if the void diameters exceed a maximum of 5,000 μm, there is an undesirable deterioration in the strength of the material. Although the shape of the voids is not limited in particular, preferably it should be close to a sphere, and it is desirable that these spherical voids make point contact with each other, resulting in interconnected and inter-communicating voids and the formation of continuous voids.

The acoustic absorber of the present invention is characterized by the tendency of the voids to become smaller in diameter from the rear surface to the front layer, so any crack produced in the middle portion of the absorber propagates more slowly as the crack tip advances towards the front layer, therefore peeling or cracking an the surface of the light-weight ceramic acoustic absorber, due to thermal stresses, occurs very rarely. Hence, the absorber has an excellent resistance to thermal stresses.

Next, the method of manufacturing the light-weight ceramic acoustic absorber in accordance with the present invention is described. First, a ceramic slurry is manufactured. Using the aforementioned alumina based ceramic powder as the raw material, the ceramic and SiC whiskers are mixed with an aqueous solution containing a dispersant, an organic binder and a foaming agent, into a foamed slurry. Next, the slurry is poured into molding dies, and the increase in the diameters of voids caused by the voids coalescing is controlled by the rate at which the slurry is dewatered and dried. The molded part is removed from the dies, degreased and baked, into a finished ceramic. When producing the slurry, the preferred amount of water to be added is normally in the range of 25 to 50 parts by weight for every 100 parts by weight of the ceramic powder raw material. If the amount is less than 25 parts by weight, the slurry is difficult to work with, and if the amount exceeds 50 weight parts, the moisture content is excessive, and the slurry takes a long time to solidify after casting, which is not desirable. In the above-mentioned method, an organic binder known in the state of the art can be used, and preferably polyvinyl alcohol, an acryl based resin, methylcellulose, etc. can be used to advantage.

A necessary condition for the foaming agent in the above description is that the diameter of the voids is in the range of 10 μm to 2,000 μm after foaming, and more explicitly, a protein based foaming agent, and more practically, it is advantageous to use a protein based foaming agent or a foaming agent consisting of albumen and a surfactant. In addition, various additives such as a lubricant, a dispersant and a surfactant known in the prior art can also be added to the above-mentioned slurry. As a typical dispersant, an ammonium polycarboxylate based dispersant (anion based dispersant) can be included. Preferred examples of surfactants include alkylbenzene sulfonate, higher alkylamino acid, etc. Within the scope of the claims of the present invention, suitable amounts of a thickener, a sizing agent, etc. known in the prior art can also be added in accordance with conventional methods, when required. Examples of thickeners, sizing agents, etc. include methylcellulose, polyvinyl alcohol, sacchalose, molasses, xanthene rubber, etc. Adding these materials results in strong and stabilized voids.

According to the manufacturing method of the present invention, a slurry with air bubbles is poured into molding dies, and the dewatering and drying of the slurry is controlled by adjusting the water absorption rate of the dies and using an optimum material for the dies. Thus, the coalescence of the bubbles is controlled, and the trend in the variation of the void diameters is also controlled. In other words, when a high dewatering rate is used, the drying finishes earlier, and as a result, not only do the air bubbles not grow, but also the bubbles are crushed during solidification, and a dense layer is formed. On the other hand, when a small dewatering rate is used, the air bubbles grow while the molded part is solidifying, so large voids remain. Accordingly, voids with diameters varied in the preferred manner can be produced during the dewatering process, by controlling the dewatering and drying rates of the molded body, by adjusting the hygroscopicity of the dies, the void ratio, the void diameters, the temperatures of the slurry and dies, the slurry casting pressure, etc. The light-weight ceramic acoustic absorber thus manufactured in accordance with the present invention is suitable particularly for an acoustic absorber for a jet engine, but the absorber can also be applied, for example, to building materials, electronic devices, mechanical components, etc.

The present invention will be described in detail referring to embodiments and comparisons, however the present invention shall not be restricted only to these embodiments.

[Embodiment 1]

A light-weight ceramic acoustic absorber was manufactured using raw materials consisting of an alumina based ceramic powder (with a mean grain diameter of 0.6 μm), and SiC whiskers (with a diameter of 0.5 μm and a length of 15 μm) as the silicon carbide fibers. The alumina based ceramic powder was added by 285 g to a solution containing 18 g of an ammonium polycarboxylate based dispersant, 5 g of an acryl emulsion based binder, 5 g of an anion surfactant based foaming agent, and 1 g of a thickener in water. The solution was mixed in a ball mill using a pot with a capacity of 200 ml, to produce a foamed slurry. The foamed slurry was poured into dies, dewatered, dried, and the molded part was removed from the dies, and the bulk density of the absorber product was measured and found to be 0.3 g/cm$^3$. A section was cut through this absorber, and inspection showed that there were voids with diameters in the range of 10 to 500 μm near the front surface, and that the diameters became larger towards the rear surface. In the center, there were voids with diameters in the range of 1,000 μm to 3,000 μm and in the proximity of the rear surface, voids with a maximum diameter of 5,000 μm were found. Consequently, it was verified that the absorber contained voids with diameters controlled in accordance with the distance from the front and near surfaces. The voids were substantially spherical, consisting mainly of continuous voids.

Next, the absorber, removed from the dies, was heated at 600° C. in air for 5 hours for degreasing, and baked at 1,650° C. for one hour in air, thereby completing the manufacture of the light-weight ceramic acoustic absorber in accordance with the present invention. The finished absorber was substantially free from warping or cracks, and as a result of observing a surface sectioned through the absorber, it was seen that there were voids in the range of 10 to 500 μm in diameter near the front surface, together with other voids in the range of 1,000 μm to 3,000 μm in the center portion and other voids with a maximum diameter of 5,000 μm in the vicinity of the rear surface. This confirmed as a result that the absorber contained voids with diameters controlled in accordance with the depth from the front surface.

[Embodiment 2]

In Embodiment 1, various types of ceramic matrix composite (CMC) acoustic absorbers were manufactured by varying the types and quantities of silicon carbide fibers, and the physical properties were measured. The results are shown in Table 1 and FIG. 3.

TABLE 1

| Case No. | Additive/ Amount | Bulk Density [g/cm$^3$] | Apparent Void Ratio [%] | Bending Strength [MPa] | Mean Void Diameter [μm] Top Surface | Mean Void Diameter [μm] Bottom Surface |
|---|---|---|---|---|---|---|
| 1 | 0 | 0.33 | 92 | 1.1 | 200 | 4200 |
| 2 | 0 | 0.53 | 87 | 2.7 | 160 | 3200 |
| 3 | 0 | 0.77 | 81 | 9.7 | 50 | 1500 |
| 4 | SiC Whisker/ 3 wt % | 0.33 | 92 | 1.2 | 300 | 3400 |
| 5 | SiC Whisker/ 3 wt % | 0.54 | 87 | 2.6 | 220 | 2300 |
| 6 | SiC Whisker/ 3 wt % | 0.7 | 93 | 7.3 | 80 | 1000 |
| 7 | SiC Whisker/ 5 wt % | 0.34 | 92 | 1.6 | 450 | 3000 |
| 8 | SiC Whisker/ 5 wt % | 0.46 | 89 | 3.2 | 300 | 1900 |
| 9 | SiC Whisker/ 5 wt % | 0.65 | 84 | 9.8 | 170 | 800 |
| 10 | Tyrano chop/ 5 wt % | 0.81 | 80 | 15.1 | 50 | 500 |

Figure 3:
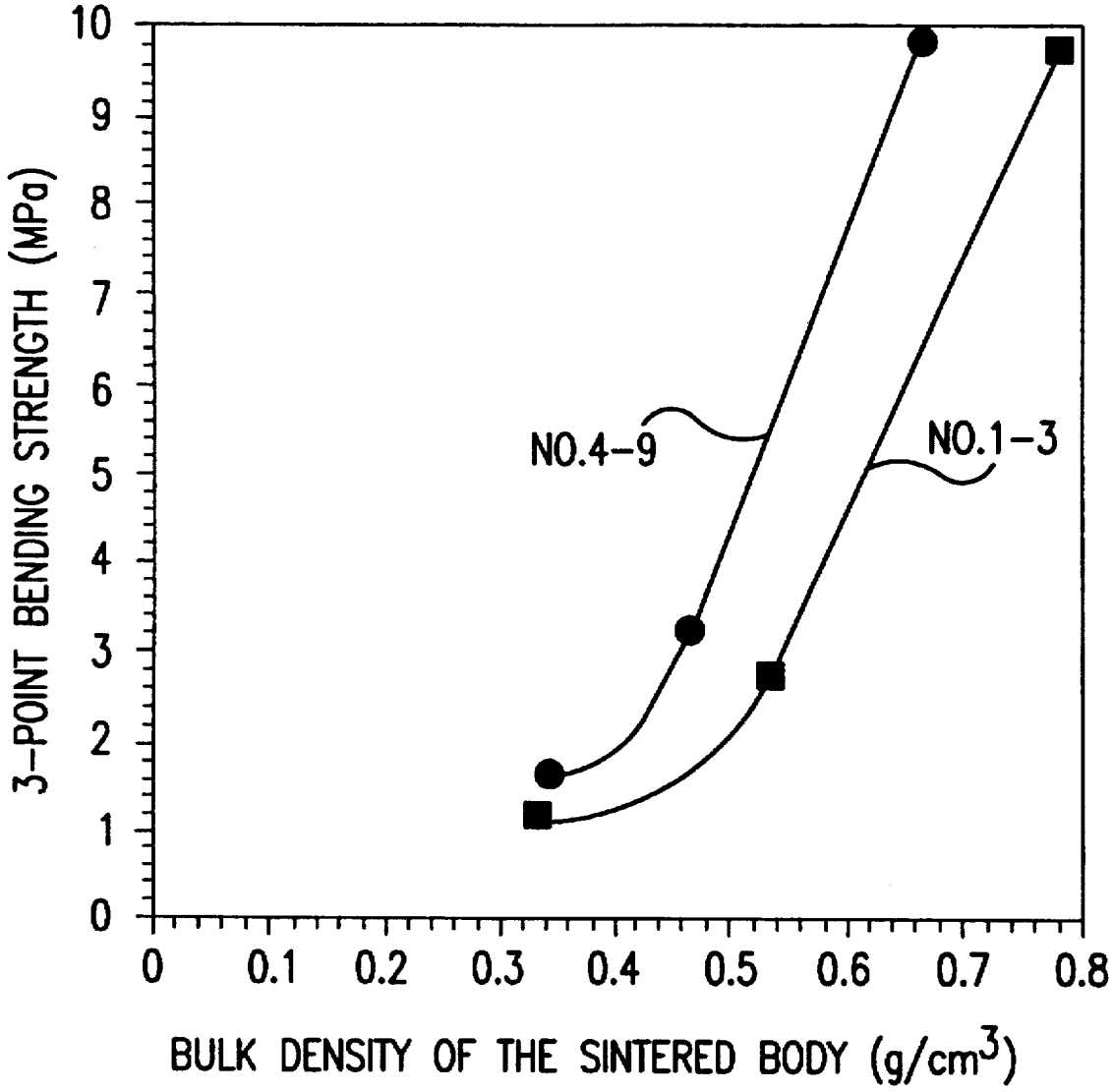
FIG. 3 is a diagram showing the relationship between bulk density and bending strength.

Obviously from Table 1 and FIG. 3, a perforated body with added silicon carbide fibers in accordance with the present invention, has a higher strenth than one with a rather high void ratio. Therefore, it is understood that a light, rigid perforated body can be produced. In addition, it is also verified that the condition of the voids at the front and rear surfaces can be freely controlled by the manufacturing method of the present invention, and a perforated body with voids which are intentionally controlled in diameter and distribution, can be obtained.

[Embodiment 3]

Various light-weight ceramic acoustic absorbers were manufactured by methods similar to those used for Embodiments 1 and 2, and compared with conventional light-weight ceramic acoustic absorbers. The results are shown in Table 2 and FIGS. 4A and 4B.

Figure 4A:
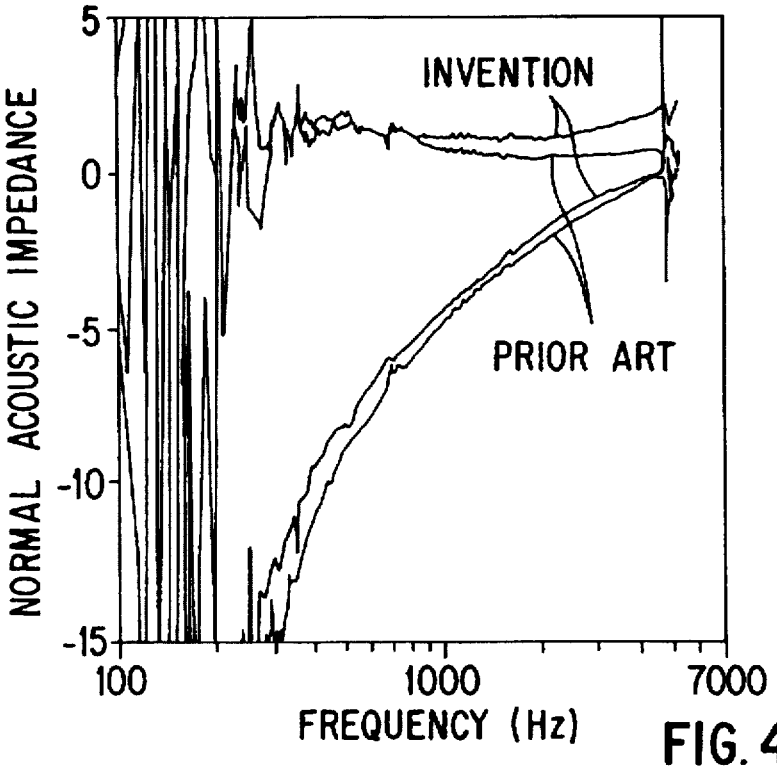
FIG. 4A is a graph showing the relationship between normal acoustic impedance and frequency in the acoustic absorber in accordance with the present invention.
Figure 4B:
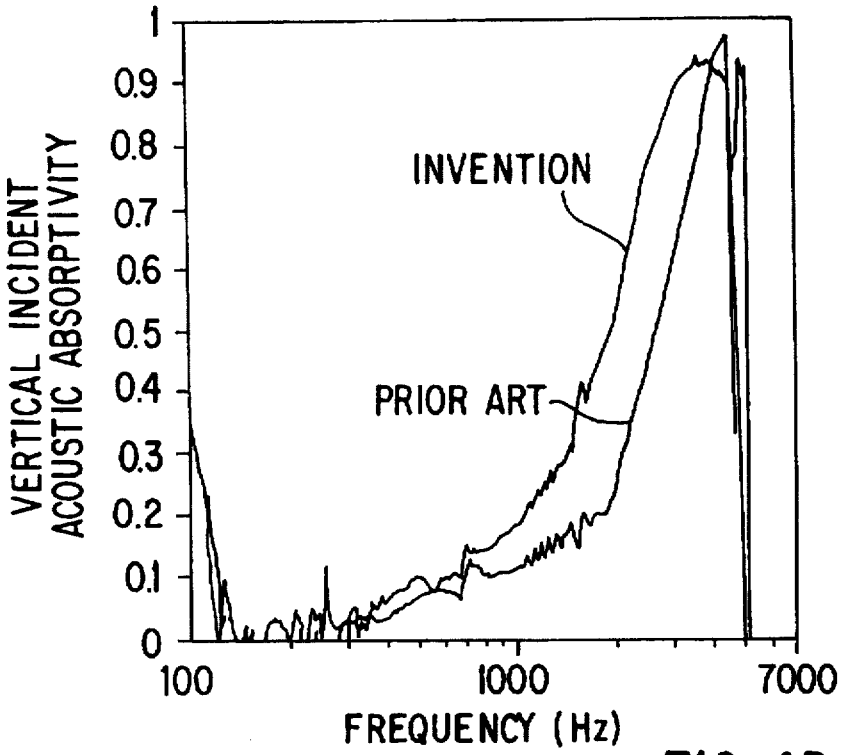
FIG. 4B is a graph showing the relationship between vertical incident acoustic absorptivity and frequency in the acoustic absorber in accordance with the present invention.

Table 2 shows a comparison between the light-weight ceramic acoustic absorber produced in accordance with the present invention, with conventional absorbers without fibers (known in the prior art). FIGS. 4A and 4B shows the frequency characteristics of the acoustic absorbers corresponding to Cases 5 and 6 of Table 2. The void ratios in Table 2 and FIGS. 4A and 4B are given by (1−bulk density/specific gravity)×100. The units of flow resistance are 10 cgs·Rayls/cm=10 k ·mks·Rayls/m=10 Pa·sec/m=10 kg/m/sec.

TABLE 2

| Case No. | Whiskers | Bulk Density [g/cm³] | Void Ratio [%] | Mean Flow Resistance [cgsRayls/cm] | Acoustic Absorptivity 1 kHz | 2 kHz | 3 kHz | 4 kHz |
|---|---|---|---|---|---|---|---|---|
| 1 | Absent | 0.31 | 92 | 2.67 | 0.07 | 0.11 | 0.18 | 0.3 |
| 2 | Present | 0.33 | 92 | 3.78 | 0.08 | 0.12 | 0.22 | 0.38 |
| 3 | Absent | 0.52 | 87 | 5.88 | 0.08 | 0.14 | 0.26 | 0.4 |
| 4 | Present | 0.54 | 86.5 | 9.69 | 0.1 | 0.18 | 0.37 | 0.64 |
| 5 | Absent | 0.77 | 81 | 27 | 0.11 | 0.27 | 0.6 | 0.9 |
| 6 | Present | 0.7 | 82.5 | 60.6 | 0.2 | 0.55 | 0.88 | 0.94 |

As shown in Table 2, the acoustic absorptivity increases with increasing flow resistance, and the flow resistance can be controlled, obviously, by adding silicon carbide fibers, without a substantial change in bulk density.

Furthermore, FIGS. 4A and 4B reveals that the light-weight ceramic acoustic absorber containing silicon carbide fibers in accordance with the present invention, particularly in the Cases 5 and 6, provides an improvement of about 10% to 30% in acoustic absorptivity compared with conventional acoustic absorbers without fibers, over a frequency range of 1 kHz to 4 kHz.

In accordance with the configuration of the present invention as described above, an alumina based ceramic contains 80% to 92% voids by volume, so the ceramic is light. Also because the ceramic is reinforced with SiC whiskers (silicon carbide fibers), the ceramic has excellent resistance to thermal stresses, so that the ceramic can resist a gas jet for a long time even if directly exposed. Moreover, the ceramic contains voids with a mean diameter in the range of 50 to 450 μm near the front surface, and the voids become larger as getting closer to the rear surface. In the proximity of the rear surface, voids have a mean diameter in the range of 500 to 3,400 μm, that is, the diameters of the voids are intentionally controlled and distributed, so even if a crack is produced locally, the rate of the crack growth becomes smaller as it approaches the front layer. In addition, the ceramic is reinforced with SiC whiskers (silicon carbide fibers), hence the resistance to thermal stresses can be further increased, and therefore cracks cannot be produced in the front layer.

In accordance with another aspect of the present invention, alumina based ceramic powder and SiC whiskers are mixed with a solution containing a dispersant, an organic binder and a foaming agent in water, and a foamed slurry is produced. The slurry is poured into molding dies, and the increase in bubble diameters caused by coalescence of the bubbles is controlled by the rate at which the slurry is dewatered and dried. The molding is removed from the dies, degreased and baked. In this way, the SiC whiskers (silicon carbide fibers) can be incorporated into the alumina based ceramic, and by controlling the dewatering and drying by changing the water absorption rates of the dies and using different materials for the dies, the growth of the voids can be controlled. Thus, a dense layer can be formed simultaneously with the production of voids with controlled diameters and distribution.

Consequently, the light-weight ceramic acoustic absorber and its manufacturing method in accordance with the present invention provide various advantages such as light-weight, high resistance to thermal stress, high acoustic absorption, and high resistance to the gas jet from a jet engine.

Figure 5:
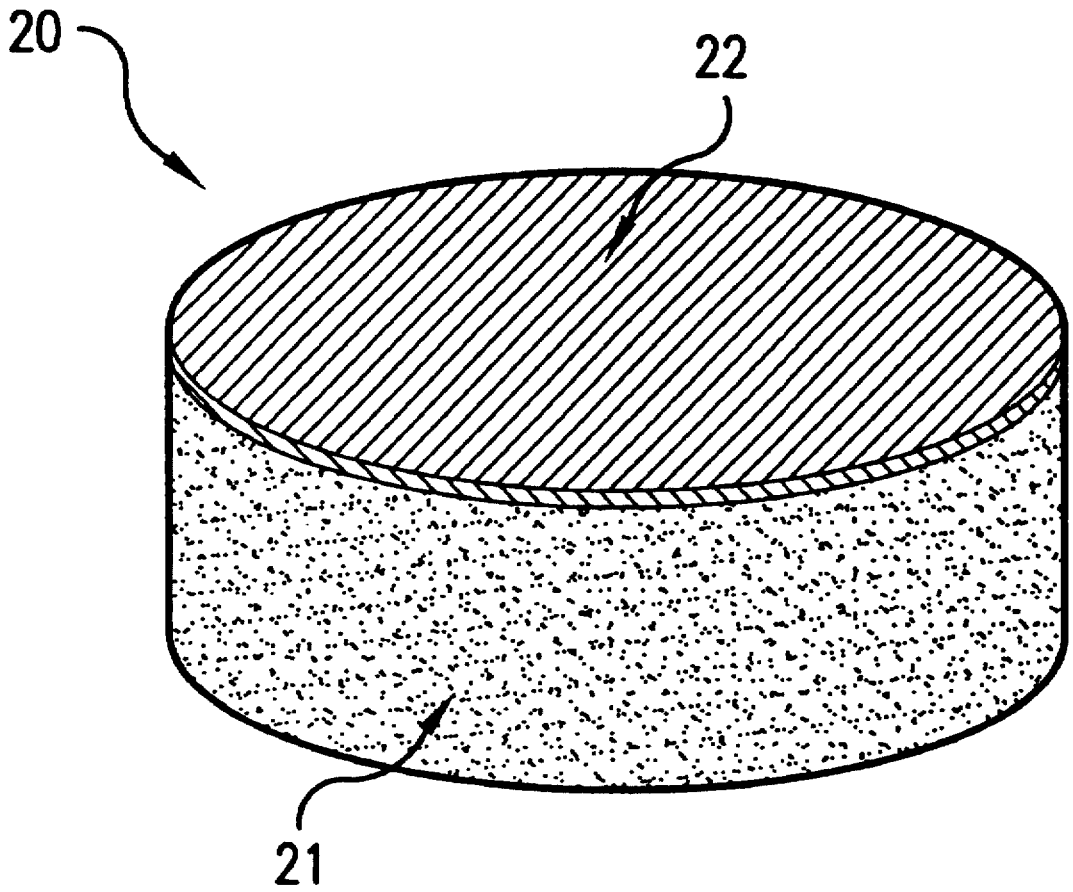
FIG. 5 is a general structural view of the acoustic absorber in accordance with the present invention.

FIG. 5 is a schematic view of the light-weight ceramic acoustic absorber in accordance with the present invention. As shown in this figure, the light-weight ceramic acoustic absorber 20 of the present invention consists of a foamed ceramic 21 and a dense layer 22 and the dense layer 22 contains ceramic fibers and is reinforced by the fibers.

The foamed ceramic 21 is a perforated body with a void ratio in the range of 80 to 92%, and there are voids with a mean diameter in the range of 50 to 450 μm near the surface in contact with the dense layer 12, and as they get closer to the rear surface, the diameters of the voids become larger, and in the proximity of the rear surface, the mean diameter of the voids becomes 500 to 3,400 μm, so the diameters of the voids gradually increase from the front to rear surfaces. By virtue of this configuration, even if a crack is produced locally, its growth rate slows down as it approaches the front layer, therefore surface peeling or facial cracking of the light weight ceramic acoustic absorber due to thermal stresses can occur very rarely, and so the absorber can demonstrate excellent resistance to thermal stresses and high strength.

The dense layer 22 is integrated with the surface of the foamed ceramic 21. The dense layer 22 is reinforced with ceramic fibers as mentioned before. The ceramic fibers should preferably consist of fabrics made of ceramic, or SiC whiskers. The thickness of the dense layer 22 is about 1,000 μm or less, and it includes voids with a mean diameter in the range of 10 to 50 μm, hence the noise confining effect to be described later can be acquired from the dense layer 22, resulting in a higher acoustic absorptivity. Since the dense layer 22 is reinforced with the ceramic fibers, the resistance to thermal stresses can be raised further, and even if the absorber is exposed directly to a gas jet, it can withstand it for a long time.

It is preferred that the dense layer has a flow resistance of about 4 to 60 cgs Rayls/cm. Compared with an absorber which has a flow resistance of about 1 cgs Rayls/cm, the above-mentioned range of flow resistance can improve the noise absorption, particularly at about 1 kHz by about 20 to 50%.

The light-weight ceramic acoustic absorber in accordance with the present invention is manufactured as follows. A foamed slurry is produced by mixing a solution that contains ceramic powder, a dispersant, an organic binder and a foaming agent in water, and ceramic fibers are placed at the location of the dense layer in the molding dies. The slurry is poured into the molding dies, and the increase in bubble diameters caused by coalescence of the bubbles is controlled by the rates at which the slurry is dewatered and dried. The molded part is removed from the dies, degreased and baked. Thus, a dense layer with ceramic fibers can be integrated into the foamed ceramic, and by controlling the dewatering and drying conditions by changing the dewatering rate of the dies and using a different material for the dies, the growth rate of the voids can be controlled, so that voids with controlled diameters can be produced at the same time as forming the dense layer. Hence, an acoustic absorber with voids whose diameters are controlled and intentionally distributed, can be manufactured rather easily and cheaply.

The dense layer is manufactured by either using highly hygroscopic dies made of gypsum etc., or exposing the surface of the dies to air. That is, the drying rate of the surface is increased, thereby creating a dense layer with a low void ratio.

The growth of the voids can be controlled by adjusting the dewatering and drying rates, by using a different material for the molding dies and by changing the dewatering rate. Taking advantage of this process, the diameters and locations of the voids can be controlled from the front to the rear surfaces, and as a result, the resistance to thermal stresses and the strength of the absorber can be increased drastically.

More details of the present invention will be described below. The ceramic content of the light-weight ceramic acoustic absorber in accordance with the present invention is not limited specifically, but consists of oxide or nonoxide based ceramic or clay minerals. One type or a plurality of these materials in a mixture can be used, and preferably, the material or materials should be used in a powder or a powder-like form. Such oxide based ceramic include alumina, mullite, zirconia, etc., and the non-oxide based ceramic include silicon carbide, silicon nitride, aluminum nitride, boron nitride, graphite, etc.

With a light-weight ceramic acoustic absorber in accordance with the present invention, the void ratio is in the range of 80 to 92%, and there are voids with a mean diameter in the range of 50 to 450 μm near the front surface, and at locations approaching the rear surface, the voids become larger, and the mean void diameter is in the range of 500 to 3,400 μm in the proximity of the rear surface. That is, there are voids with controlled diameters distributed between the front and rear surfaces.

In accordance with the principles of the present invention, the voids are arranged intentionally so that the diameters are controlled in accordance with the depth from near the front to the rear surfaces. However, if the void ratios are less than 80%, the preferred characteristic of light weight is lost. If the void ratios exceed 92% on the other hand, the strength decreases disadvantageously.

The present invention provides voids with diameters in the range of 10 to 500 μm near the front surface, but if the diameters of the voids are less than 10 μm, the absorber cannot demonstrate the required characteristics as an acoustic absorber, and also it is not preferred because it loses the property of being light-weight. If the diameter exceeds 500 μm, this is also not desirable as the effect of the controlled diameters and intentional distribution of the voids decreases and also this causes a deterioration in strength and is an occasional cause of cracks that may occur during casting. Since there are voids with a mean diameter in the range of 500 to 3,400 μm near the rear surface, an acoustic absorber with a significant variation in the controlled diameters of the voids and their intentional distribution is produced, so the strength can also be accepted in practice. However, if the void diameters exceed a maximum of 5,000 μm, the strength deteriorates undesirably. The shape of a void is not restricted in particular, but a nearly spherical void is preferred, and these spherical voids should preferably consist of intercommunicating voids resulting from point contacts.

Because the acoustic absorber of the present invention is provided with voids whose diameters are large at the rear surface and small at the front, with a trend of controlled diameters and distribution, any crack produced propagates more slowly as the tip approaches the front layer, and as a result, surface peeling or facial cracking of the light-weight ceramic absorber due to thermal stresses can only occur very rarely, that is, the resistance of the absorber to thermal stresses is excellent.

Next, the method of manufacturing the light-weight ceramic acoustic absorber of the present invention will be described below. First, a ceramic slurry is manufactured. Using as a raw material the aforementioned oxide or non-oxide based ceramic powder, a solution that contains the ceramic powder, a dispersant, an organic binder and a foaming agent in water is mixed to produce a foamed slurry. Then, ceramic fibers are placed at the location of the dense layer in the molding dies. The foamed slurry is poured into the molding dies, and the increase in void diameters caused by coalescence is controlled by the rate at which the slurry is dewatered and dried. The molded part is removed from the dies, degreased and baked to form the completed product. In manufacturing the slurry, the preferable amount of water to be added is normally in the range of 25 to 50 parts by weight to 100 parts by weight of the ceramic powder raw material. If the water is less than 25 parts by weight, it becomes difficult to manufacture the slurry, and if the water content exceeds 50 parts by weight, it takes a long time for the slurry to solidify after molding because of the excessive water content, so this is not preferred. In the above description, the organic binder can be selected from those known and used in the state of the art, and preferably it should be polyvinyl alcohol, acryl based resins or methylcellulose, etc.

For the foaming agent in the above description, the preferred condition is that the void diameters should become 10 μm to 2,000 μm after foaming. More explicitly, a foaming agent whose main constituent is either a protein based foaming agent, albumen or surfactant, is preferred. In addition, the above-mentioned slurry can also contain various additives such as a lubricant, a dispersant, a surfactant, etc. known in the prior art in accordance with conventional methods, whenever required. Typically, an ammonium polycarboxylate based dispersant (anion based dispersant) can be used. Applicable surfactants include alkylbenzene sulfonate, higher alkylamino acids, etc. According to an aspect of the present invention, a thickener, sizing material, etc. known in the prior art can also be added in accordance with conventional methods, whenever required. Such useful thickeners, sizing materials, etc. include, for example, methylcellulose, polyvinyl alcohol, saccharose, molasses, xanthene rubber, etc. Adding any of these can improve the strength of the voids and stabilize the voids.

In accordance with the manufacturing method of the present invention, the foamed slurry is poured into molding dies, the material of the dies is selected and the water-absorbing rate of the dies is adjusted, so that the dewatering and drying rates of the slurry are controlled, thereby controlling the growth of the foam. In this way, the diameters and locations of the voids are controlled intentionally. In other words, as the dewatering rate is increased, the drying takes place earlier, resulting in not only a slowdown of bubble growth, but also crushing of the bubbles during solidification and the formation of a dense layer. With a smaller dewatering rate on the other hand, the walls of all the bubbles solidify as they are growing, so larger bubbles remain. As described above, the dewatering and drying rates for a molding are adjusted by controlling the water absorption rate of the dies, the void ratio, void diameter, temperature of the slurry and dies, slurry casting pressure, etc., and as a result, voids can be distributed in such a way that the diameters are intentionally controlled in accordance with their location. The light-weight ceramic acoustic absorber manufactured in this way in accordance with the present invention, is particularly suitable for use as an acoustic absorber for a jet engine, but the absorber can also be applied to other uses, such as for building materials, electronic devices, mechanical components, etc.

[Embodiment 4]

A light-weight ceramic acoustic absorber was manufactured using as raw materials, an alumina based ceramic powder (with a mean grain diameter of 0.6 μm) and an inorganic fiber material. A solution was prepared by dissolving 18 g of an ammonium polycarboxylate dispersant, 5 g of an acryl emulsion based binder, 5 g of an anion surfactant based foaming agent, and 1 g of a thickener in 140 g of water, and 285 g of alumina based ceramic powder was added to the solution, and a foamed slurry was produced by mixing the solution in a ball mill, using a pot with a capacity of 200 ml. The foamed slurry was poured into molding dies, and after dewatering and drying, the molding was removed from the dies, and the bulk density of the absorber was measured. The result was 0.3 g/cm$^3$. Sections of the absorber were observed and found to have voids with diameters in the range of 10 to 500 μm near the front surface, and the diameters of the voids became larger towards the rear surface. It was also found that there were voids with diameters in the range of 1,000 μm to 3,000 μm in the center and voids with a maximum diameter of 5,000 μm near the rear surface. It was shown therefore that voids were included with diameters which tended to increase from the front to the rear surface. In addition, it was observed that the voids were substantially spherical, and mainly consisted of communicating voids.

Next, the acoustic absorber, removed from the dies, was degreased by heating at 600° C. in air for 5 hours, then the absorber was baked at 1,650° C. for an hour in air, to finish the production of the light-weight ceramic acoustic absorber in accordance with the present invention. The finished absorber was free from significant warping or cracks, and by inspecting sectioned surfaces of the absorber, it was shown that there were voids with diameters in the range of 10 to 500 μm near the front surface, with diameters in the range of 1,000 μm to 3,000 μm in the center portion, and with a maximum diameter of 5,000 μm near the rear surface. Therefore, it was confirmed that voids were present from the front to the rear surfaces, with the diameters controlled to the desired values at each location.

[Embodiment 5]

Foamed ceramic was manufactured in the same way as for Embodiment 4, and a dense layer was created on the surface of the ceramic by using dies made of gypsum etc., for example, with a high hygroscopicity.

Figure 6:
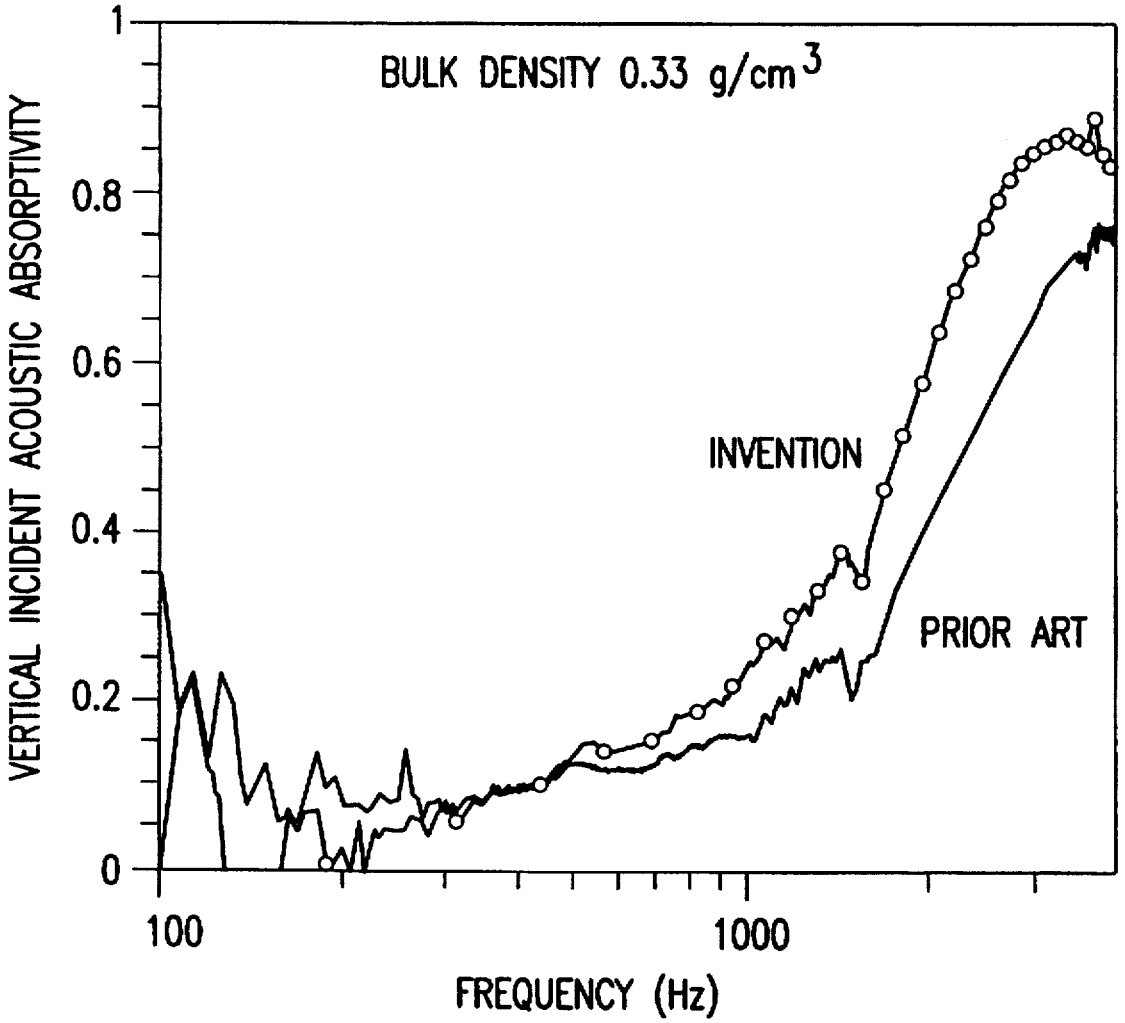
FIG. 6 is a frequency characteristic curve of the acoustic absorber in accordance with the present invention.
Figure 7:
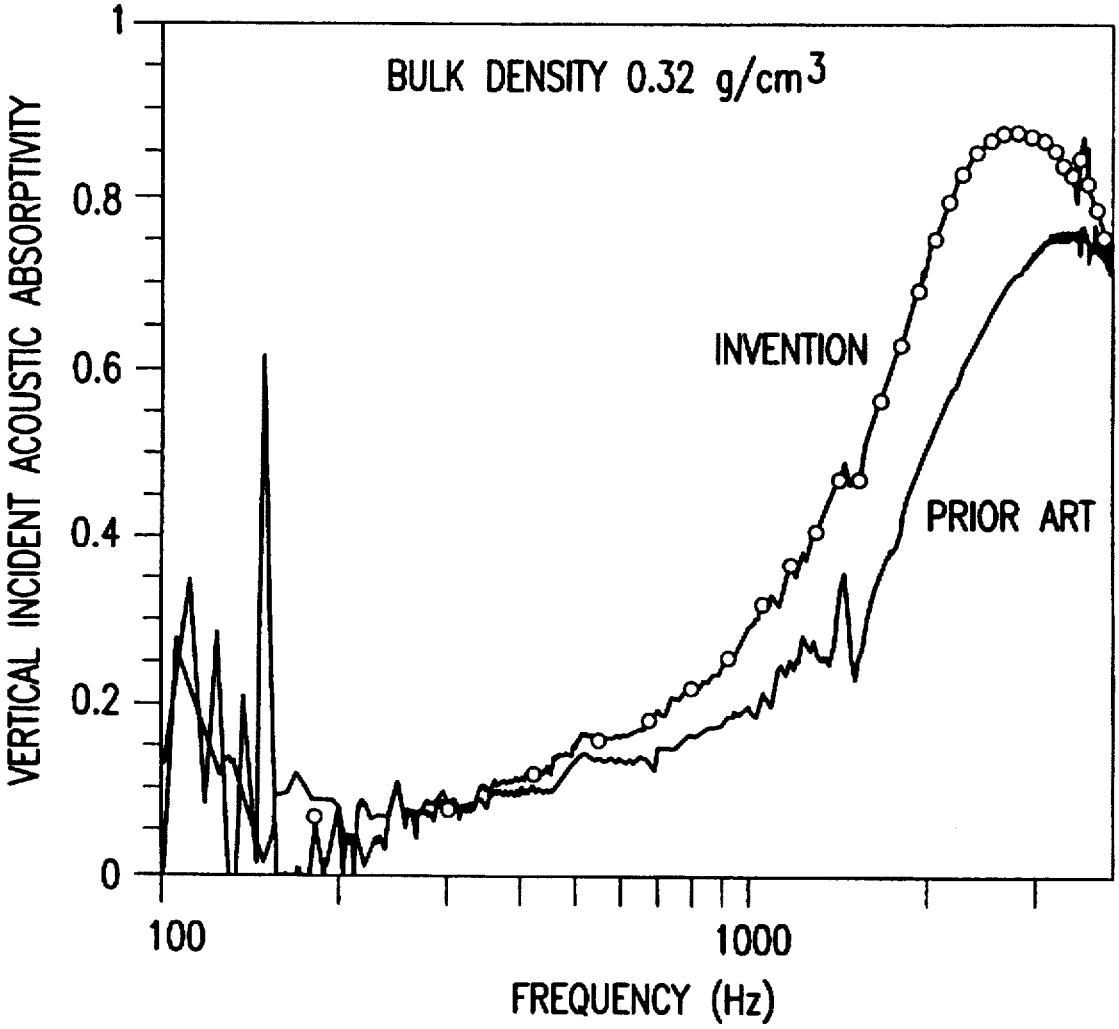
FIG. 7 is another frequency characteristic curve of the acoustic absorber in accordance with the present invention.
Figure 8:
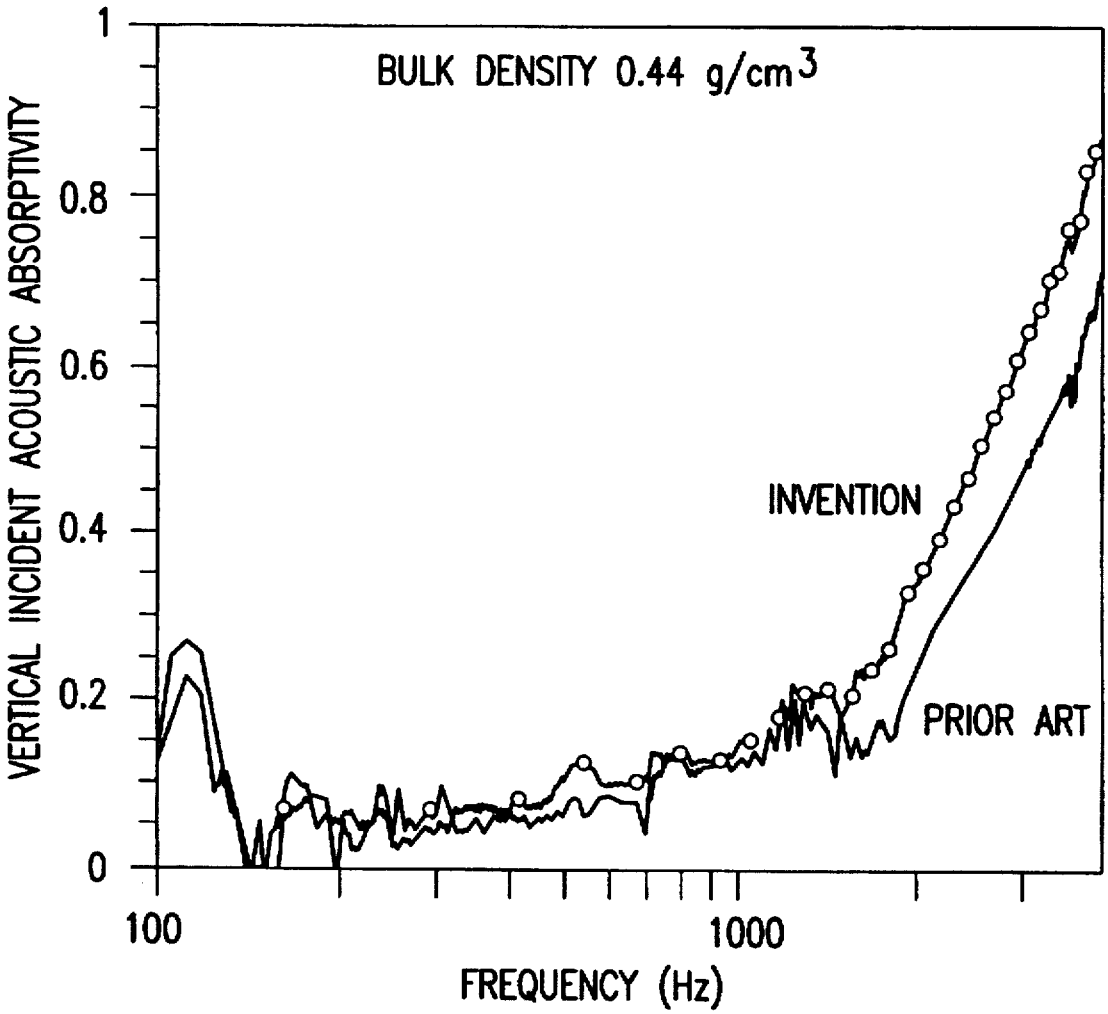
FIG. 8 is another frequency characteristic curve of the acoustic absorber in accordance with the present invention.

Table 3 shows a comparison between the light-weight ceramic acoustic absorber produced in this embodiment (in accordance with the present invention) and an absorber without a dense layer (prior art). FIGS. 6, 7 and 8 show frequency characteristic curves of the acoustic absorptivities corresponding to the data in Table 3.

TABLE 3

| Bulk Density | Mean Flow Resistance | Void Ratio | Thickness | Raw | Acoustic Absorptivity | | | |
|---|---|---|---|---|---|---|---|---|
| [g/cm$^3$] | [cgsRayls/cm] | [%] | [mm] | Material | 1 kHz | 2 kHz | 3 kHz | 4 kHz |
| 0.33 | 4.3 | 92 | 21 | Prior Art | 0.18 | 0.43 | 0.68 | 0.74 |
| | | | | Invention | 0.24 | 0.64 | 0.85 | 0.8 |
| 0.32 | 4.4 | 92 | 24 | Prior Art | 0.2 | 0.5 | 0.73 | 0.64 |
| | | | | Invention | 0.28 | 0.74 | 0.87 | 0.7 |
| 0.44 | 14.3 | 89 | 12 | Prior Art | 0.13 | 0.25 | 0.5 | 0.75 |
| | | | | Invention | 0.14 | 0.36 | 0.64 | 0.86 |

As shown in Table 3, it can be seen that the light-weight ceramic acoustic absorber of the present invention, with the foamed ceramic, i.e., an acoustic absorber with a void ratio in the range of 80 to 92% and a dense layer, provides absorptivity increases with a maximum of 24% and a maximum of 14% for a thickness of the dense layer of 24 mm and 12 mm, respectively, compared with the conventional acoustic absorber without a dense layer, over a range of frequencies between 1 kHz to 4 kHz.

FIGS. 6 to 8 also show that the acoustic absorber of the present invention with a dense layer has an acoustic absorptivity of about 10% greater than a conventional absorber in the frequency range of 1,000 to 3,000 Hz.

[Embodiment 6]

In accordance with the same method as that for Embodiment 5, the flow resistance of the facial dense layer was changed, and a light-weight ceramic acoustic absorber was manufactured in accordance with the present invention.

Figure 9:
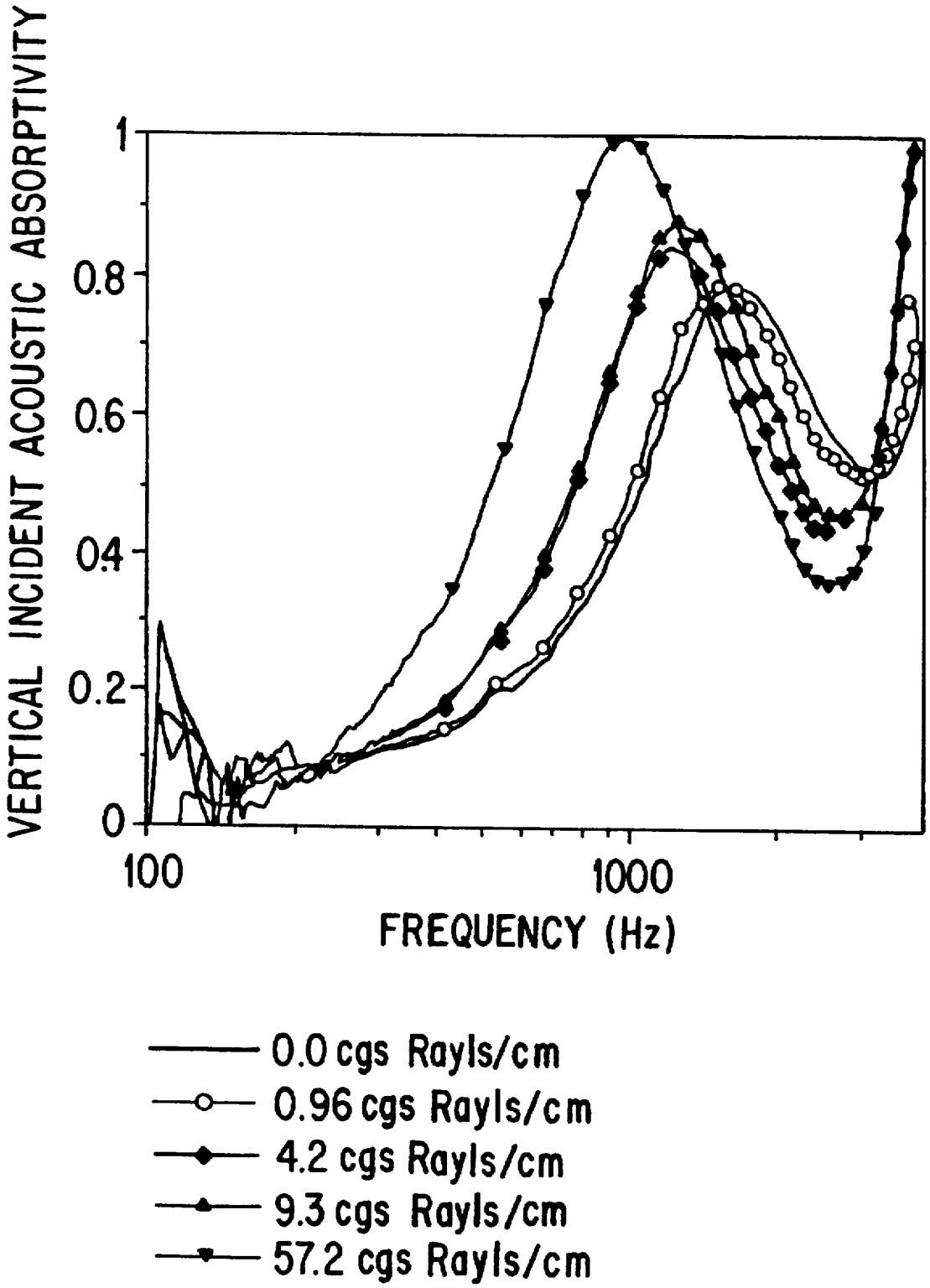
FIG. 9 is another frequency characteristic curve of the acoustic absorber in accordance with the present invention.

Table 4 shows a comparison between the light-weight ceramic acoustic absorber produced by the present invention and an acoustic absorber using a metal face plate (prior art). FIG. 9 is a frequency characteristic curve of the acoustic absorptivities corresponding to the data in Table 4.

TABLE 4

| Bulk Density | Mean Flow Resistance | Thickness | Face Plate Thickness | Face Plate Flow Resistance | Face Plate | Acoustic Absorptivity | | | |
|---|---|---|---|---|---|---|---|---|---|
| [g/cm³] | [cgsRayls/cm] | [mm] | [mm] | [cgsRayls/cm] | Raw Material | 1 kHz | 1.25 kHz | 1.6 kHz | 2 kHz |
| 0.41 | 1.5 | 20 | 1.1 | 0.96 | Prior Art | 0.5 | 0.7 | 0.8 | 0.7 |
| | | | 3.5 | 4.2 | Invention | 0.72 | 0.84 | 0.75 | 0.54 |
| | | | 2.1 | 9.3 | Invention | 0.74 | 0.88 | 0.78 | 0.62 |
| | | | 2.8 | 57.2 | Invention | 1 | 0.86 | 0.7 | 0.47 |

From Table 4, it can be seen that an improvement in the acoustic absorptivity of about 20 to 50% can be obtained by the light-weight ceramic acoustic absorber with a dense layer which has a flow resistance of about 4 to 60 cgs Rayls/cm, compared with the acoustic absorber with a metal face plate with a flow resistance of about 1 cgs Rayls/cm (prior art), particularly at about 1 kHz.

Moreover, FIG. 9 also indicates that when compared with an absorber without a face plate, the absorber of the present invention has a greatly improved acoustic absorptivity particularly near 1 kHz.

As described above, the light-weight ceramic acoustic absorber of the present invention consists of a foamed ceramic that is, in itself, very light in weight and has a high resistance to thermal stresses, and furthermore, the dense layer provided on the surface of the ceramic can confine noise effectively.

The dense layer is also reinforced by ceramic fibers, therefore the layer can enhance the resistance of the ceramic to thermal stresses, so that the absorber can withstand a gas jet for a long time even when directly exposed.

In addition, the dense layer with a flow resistance in the range of about 4 to about 60 cgs Rayls/cm greatly contributes to an increase in the noise absorption particularly at around 1 kHz. The presence of voids with diameters which are intentionally controlled in accordance with their location can improve the resistance of the absorber to thermal stresses further because even if a crack is produced locally, its growth slows down as the crack tip approaches the surface layer, and because the dense layer of the face is reinforced by ceramic fibers. Consequently, the face layer is highly resistant to cracking, so that even if the absorber is exposed directly to a gas jet, it can withstand the exposure for a long time.

In accordance with the method of the present invention for manufacturing a light-weight ceramic acoustic absorber, ceramic fibers are placed at the position of the dense layer in the molding dies, and by pouring the aforementioned slurry into the dies, the dense layer including the ceramic fibers can be integrated into the foamed ceramic. Also by controlling the dewatering and drying rates by using a different material for the dies and by changing the dewatering rate of the dies, the growth rate of the bubbles can be controlled appropriately. Therefore voids are produced with diameters which are intentionally controlled in accordance with the location at the same time as the dense layer is formed. Also, the drying rate at the surface can be improved and a dense layer with a low void ratio can be formed on the surface by using a highly hygroscopic material such as gypsum for the dies, or by exposing the surface to air.

In conclusion, the light-weight ceramic acoustic absorber and the manufacturing method of the present invention offer various advantages such as light weight, high resistance to thermal stresses, high acoustic absorptivity, and high resistance to the gas jet from a jet engine.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A light-weight ceramic acoustic absorber comprising an alumina based ceramic containing SiC whiskers, as a perforated body with a void ratio in the range of 80 to 92%, where there are voids with a mean diameter in the range of 50 to 450 μm near the front surface of said body, and said void diameters are larger towards the rear surface of said body, and a mean diameter of said voids is in the range of 500 to 3,400 μm near the rear surface of said body, and there is an increasing trend in void diameters from said front to said rear surfaces.

2. A light-weight ceramic acoustic absorber comprising a foamed ceramic, as a perforated body with a void ratio in the range of 80 to 92%, and a dense layer containing ceramic fibers provided on the surface of said foamed ceramic, where the thickness of said dense layer is about 1,000 μm or less, and said dense layer contains voids with a mean diameter in the range of 10 to 50 μm.

3. The light-weight acoustic absorber as set forth in claim 2, wherein said dense layer has a flow resistance in the range of about 4 to about 60 cgs Rayls/cm.

4. The light-weight acoustic absorber as set forth in claim 2, wherein said foamed ceramic contains voids with a mean diameter in the range of 50 to 450 μm near the front surface in contact with said dense layer, and void diameters become larger towards said rear surface, and the mean diameter of said voids is in the range of 500 to 3,400 μm near said rear surface, and there is an increasing trend in void diameters from said front to said rear surfaces.

5. A method of manufacturing a light-weight ceramic acoustic absorber, in which an alumina based ceramic powder and SiC whiskers are mixed with a solution containing a dispersant, an organic binder and a foaming agent in water, into a foamed slurry containing bubbles, said slurry is poured into molding dies, and dewatered and dried under controlled conditions of dewatering and drying to increase the diameters of the bubbles by coalescing said bubbles, then the solidified molded part is removed from said dies, degreased and baked.

6. A method of manufacturing a light-weight acoustic absorber, in which a foamed slurry containing bubbles is produced by stirring together a solution containing a ceramic powder, a dispersant, an organic binder and a foaming agent in water, ceramic fibers are placed at the location of the dense layer in the molding dies, said slurry is poured into said dies, dewatered and dried under controlled conditions of dewatering and drying to increase the diameters of the bubbles by coalescing said bubbles, then a solidified molding is removed from said dies, degreased and baked.

7. The method of manufacturing a light-weight acoustic absorber, as set forth in claim 6, in which said dense layer is formed by increasing the drying rate at the surface of said poured slurry.

* * * * *